US006429597B1

(12) United States Patent
Flory, IV et al.

(10) Patent No.: US 6,429,597 B1
(45) Date of Patent: Aug. 6, 2002

(54) EXTERNALLY MOUNTABLE DISCHARGE LAMP IGNITION CIRCUIT HAVING VISUAL DIAGNOSTIC INDICATOR

(75) Inventors: Isaac L. Flory, IV, Blacksburg; Christopher A. Hudson, Roanoke, both of VA (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 09/797,911

(22) Filed: Mar. 5, 2001

Related U.S. Application Data

(63) Continuation-in-part of application No. 09/658,490, filed on Sep. 8, 2000, now abandoned, which is a continuation-in-part of application No. 09/172,677, filed on Oct. 15, 1998, now Pat. No. 6,127,782.

(51) Int. Cl.[7] ..... H01J 1/60; H05B 41/14

(52) U.S. Cl. ..... 315/129; 315/290

(58) Field of Search ..... 315/129, 290, 315/127, 128, 289, 135, DIG. 5, DIG. 7, 130, 276; 174/50.52, 52.1; 362/368

(56) References Cited

U.S. PATENT DOCUMENTS

| | | | | |
|---|---|---|---|---|
| 2,998,545 A | | 8/1961 | Smyth | |
| 3,012,090 A | | 12/1961 | Robbins | 174/52 |
| 3,735,378 A | | 5/1973 | McNamee | 340/251 |
| 4,068,216 A | | 1/1978 | Brouwer et al. | 340/168 |
| 4,222,047 A | | 9/1980 | Finnegan | 340/641 |
| 4,318,031 A | * | 3/1982 | Lonseth et al. | 315/133 |
| 4,496,905 A | | 1/1985 | Forte et al. | 324/414 |
| 4,730,163 A | | 3/1988 | Santos | 324/414 |
| 4,962,336 A | * | 10/1990 | Dodd et al. | 315/290 |
| 5,296,815 A | | 3/1994 | Conway et al. | 324/414 |
| 5,321,338 A | | 6/1994 | Nuckolls et al. | 315/290 |
| 5,323,116 A | | 6/1994 | Atria | 324/511 |
| 5,557,207 A | | 9/1996 | Duve | 324/414 |
| 5,614,790 A | | 3/1997 | Fleck, Sr. et al. | 315/135 |
| 6,127,782 A | * | 10/2000 | Flory et al. | 174/50.52 |

* cited by examiner

*Primary Examiner*—Don Wong
*Assistant Examiner*—Chuc Tran
(74) *Attorney, Agent, or Firm*—Stacey J. Longanecker

(57) ABSTRACT

An ignitor and ignitor monitoring device is provided which is externally and detachably mounted to a high intensity discharge (HID) luminaire. The ignitor monitoring device provides a visual indication of whether or not the ignitor of the lamp in the HID luminaire is functioning. If the lamp is not operating and the indicator is activated, sufficient open circuit voltage is present to operate the ignitor, the ballast in the luminaire is most likely functioning properly, and power is present to operate the luminaire. A service person can assume that the lamp is defective and can replace the lamp as a first attempt to correct the problem with the luminaire. If the lamp is off and the indicator is also not operating, the luminaire is not operating for any of a number of reasons such as a defective ignitor, a defective ballast capacitor, a defective lamp or loss of supply voltage from the power source. A service person can replace the ignitor in a first attempt to repair the luminaire. Replacing the ignitor is the simplest initial repair option since the ignitor is externally mounted on the luminaire.

1 Claim, 8 Drawing Sheets

EXTERNALLY MOUNTABLE DISCHARGE LAMP IGNITION CIRCUIT HAVING VISUAL DIAGNOSTIC INDICATOR

This application is a continuation-in-part of U.S. patent application Ser. No. 09/658,490, filed Sep. 8, 2000, now abandoned, which is a continuation-in-part of U.S. patent application Ser. No. 09/172,677, filed Oct. 15, 1998, now issued as U.S. Pat. No. 6,127,782.

FIELD OF THE INVENTION

The invention relates to an ignitor and ignitor indicator for facilitating the troubleshooting of a high intensity, gas discharge lamp.

BACKGROUND OF THE INVENTION

High intensity, gas discharge luminaires, which are hereinafter referred to as HID luminaires, are commonly installed at high locations at commercial or industrial facilities such as on the ceiling of a warehouse or plant, or on light poles in a parking lot or stadium. HID luminaires can include, but are not limited to, metal halide or MH lamps, and high pressure sodium or HPS lamps. HID luminaires often use pulses from a high voltage source such as a starting circuit to ignite the lamp.

In many applications, the HID luminaires can be elevated on the order of thirty feet or more above the floor or ground at a commercial or industrial facility. The elevation of the luminaires makes repair of malfunctioning luminaires inconvenient and time consuming since service personnel must ascend to considerable heights in order to gain access to the luminaires, assess the problem and then repair or replace components of the luminaire. The malfunctioning of an HID luminaire can be attributed to any of a number of problems such as a defective ballast or ballast capacitor, a defective lamp, loss of supply voltage or defective lamp starting circuit, which is hereinafter referred to as an ignitor.

A number of devices exist to facilitate the assessment of a malfunctioning luminaire. For example, U.S. Pat. No. 4,318,031, to Lonseth et al, discloses a visual monitoring device having two indicator lights for indicating the operational conditions of a lamp, a ballast and a starter circuit, as shown in FIG. 1. The first indicator light is provided across the lamp and indicates whether the lamp or the ballast have failed. The second indicator light is driven by a voltage divider circuit comprising resistors connected to the output of the ballast. The starter circuit is connected to a power source, to the ballast, and to the junction between the lamp and a lead-type ballast capacitor, and is configured to provide the lamp with pulses. The pulses are divided by the voltage divider circuit and the resulting pulses are provided to a diode. The resulting pulses are of sufficient voltage to allow the conduction of the diode and storage by a capacitor. Under normal operating conditions of the starter circuit, pulses are stored during each cycle of a 60 Hertz supply. The indicator light operates when thirty pulses are stored or twice a second.

If the indicator light does not blink and the lamp is off, then the starting circuit is malfunctioning. A service person must then interrupt the supply of power to the luminaire and ascend a ladder or use other means to reach the elevated luminaire in order to remove the luminaire from the ceiling or other surface to which it is mounted. Secondly, the luminaire housing must be opened and circuit connections disconnected to remove the malfunctioning starter circuit and replace it with a new starter circuit. As stated previously, these types of repairs are costly in terms of man-hours required to perform the above operations. Further, such repair operations can potentially expose a service person to electric shock if the luminaire housing is opened before line power to the luminaire is terminated for repair purposes. Thus, a need exists for a luminaire which has an ignitor or starting circuit that is connected to the outside of the luminaire housing, as well as an ignitor indicator. The starting circuit can therefore be removed and replaced with relative ease and without having to interrupt power to the luminaire or risk exposure to electric shock.

SUMMARY OF THE INVENTION

The present invention overcomes the deficiencies of existing lamp trouble-shooting and indicator devices and realizes a number of advantages over these existing devices. An HID luminaire is provided which comprises an externally mounted ignitor and ignitor monitoring device. The ignitor monitoring device provides a visual indication of whether or not the ignitor of the lamp in the HID luminaire is functioning. If the lamp is not on and the ignitor and ignitor monitoring device is activated, sufficient open circuit voltage is present to operate the ignitor. The ballast therefore is most likely functioning properly, and power is present to operate the luminaire. A service person can assume that the lamp is defective and can replace the lamp as a first attempt to correct the problem with the luminaire. If the lamp is off and the ignitor and ignitor monitoring device is also not operating, the luminaire is not operating for any of a number of reasons such as a defective ignitor, a defective ballast or ballast capacitor, a defective lamp or loss of supply voltage. A service person can replace the ignitor in a first attempt to repair the luminaire. Replacing the ignitor is the simplest initial repair option since the ignitor is enclosed with the ignitor monitoring device in a housing that is externally mounted on the luminaire. If the ignitor is indeed the problem, the service person has repaired the luminaire without having to disassemble the luminaire which comprises the lamp, the ballast, and other components in a luminaire housing. In addition, the risk of exposing the service person to electrocution via the power supply wires to the luminaire is reduced since the service person did not have to open the luminaire to replace the ignitor. Further, supply voltage to the luminaire did not have to be interrupted by the service person to replace the externally mounted ignitor and ignitor monitoring device.

In accordance with an embodiment of the present invention, the ignitor provides for isolation of an LED charge/discharge loop from the ignitor loop for improved fail mode operation.

BRIEF DESCRIPTION OF THE DRAWINGS

These and other features and advantages of the present invention will be more readily comprehended from the following detailed description when read in connection with the appended drawings, which form a part of this original disclosure, and wherein.

Throughout the drawing figures, like reference numerals will be understood to refer to like parts and components.

DETAILED DESCRIPTION OF THE PREFERRED EMBODIMENTS

Figure 1:
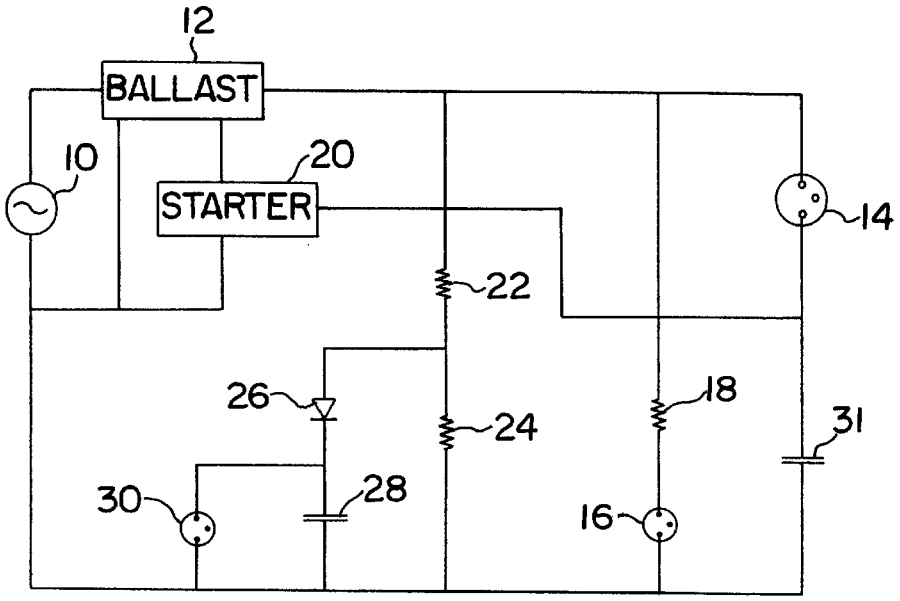
FIG. 1 PRIOR ART
FIG. 1 is an existing circuit for operating an HID lamp having a starter circuit and indicator lights.
Figure 2:
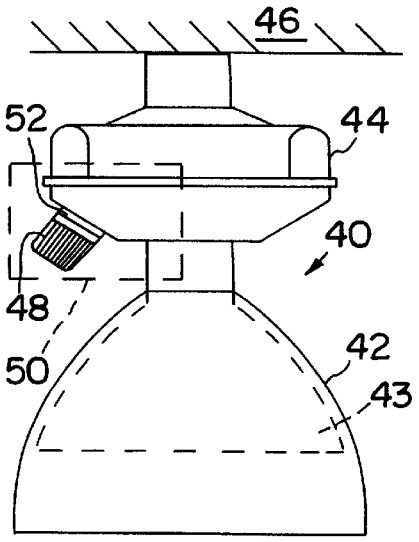
FIG. 2 illustrates a luminaire constructed in accordance with an embodiment of the present invention.

An HID luminaire 40 is depicted in FIG. 2 which has an optical assembly 42 and a luminaire housing 44. The luminaire housing is constructed to be mounted on a ceiling 46 or other surface in a conventional manner. As will be described below in connection with FIG. 8, the luminaire housing encloses a ballast for the lamp 43 contained within optical assembly 42 and other components such as electrical leads (e.g., a hot line, a common line and ground). In accordance with the present invention, an ignitor and indicator circuit 48 is mounted externally with respect to the luminaire housing 44.

Figure 3:
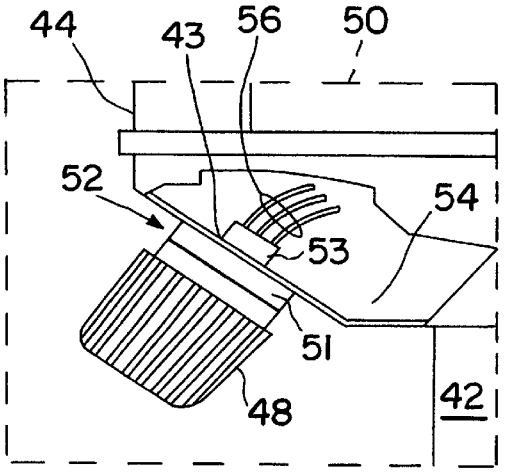
FIGS. 3 and 4 illustrate a portion of a luminaire constructed in accordance with an embodiment of the present invention.
Figure 4:
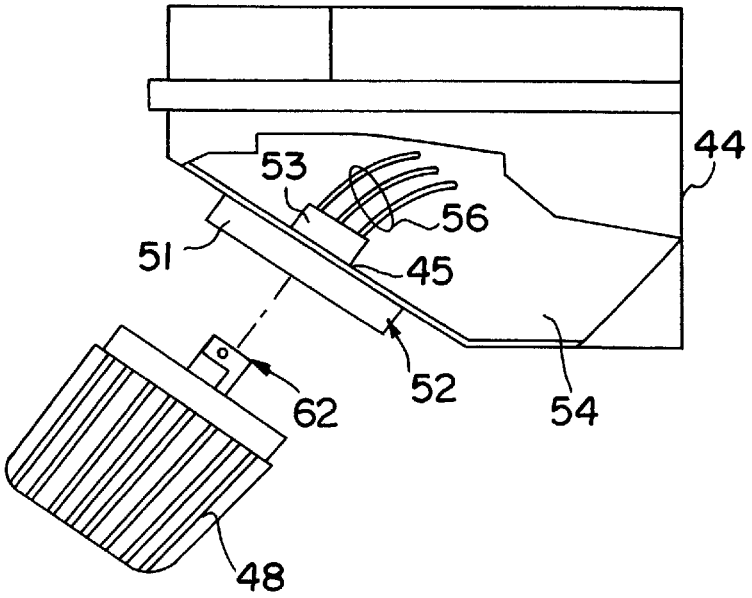
Figure 5:
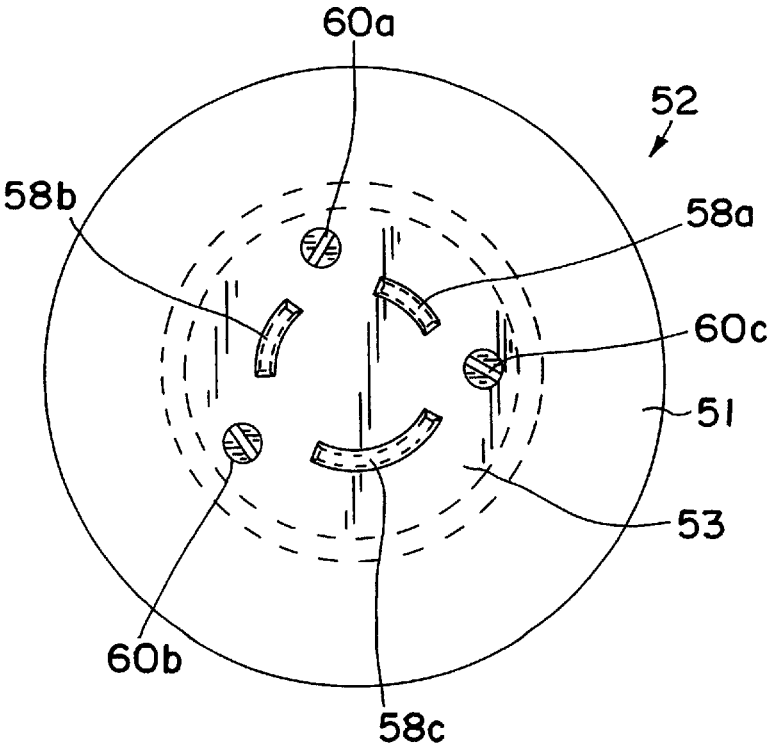
FIG. 5 is a cross-sectional view of a receptacle for an externally mounted ignitor and indicator circuit in a luminaire constructed in accordance with an embodiment of the present invention.

An enlarged view of a portion 50 of the luminaire housing 44, the optical assembly 42 and the ignitor and indicator circuit 48 is shown in FIG. 3. With reference to FIGS. 3, 4 and 5, the luminaire housing 44 is provided with a receptacle or socket 52. The receptacle or socket 52 is mounted to the luminaire housing 44 in a conventional manner. For example, the receptacle 52 can comprise a disc-shaped exterior section 51 which abuts the luminaire housing 44 and an interior cylindrical section 53 having a smaller diameter than the exterior section 51. The luminaire housing 44 is provided with an aperture 45 having dimensions to receive the interior section 51 therethrough. The exterior section 51 and the portion of the luminaire housing 44 to which the exterior section is mounted 51 can both be provided with coinciding apertures (not shown) for receiving screws 60*a*, 60*b* and 60*c*, for example, to secure the receptacle 52 to the luminaire housing 44.

Figure 6:
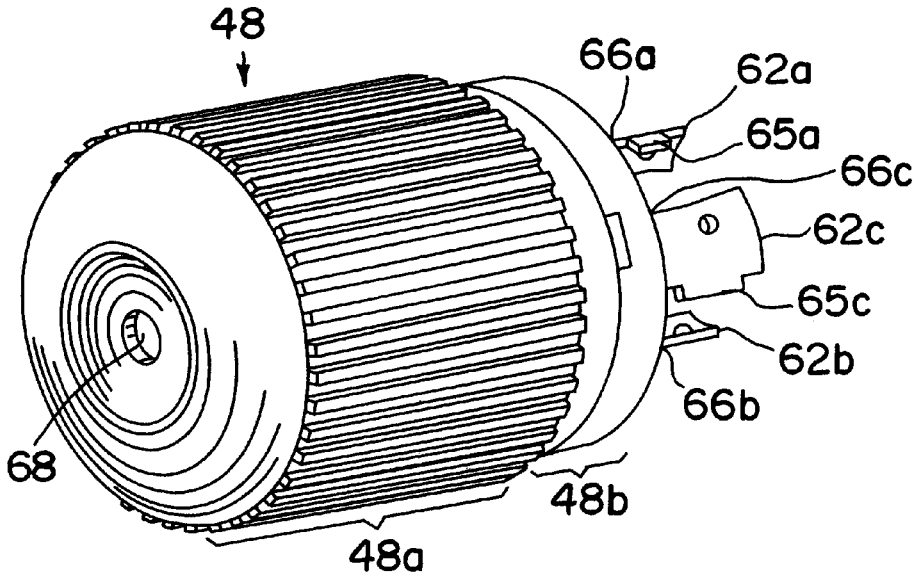
FIG. 6 is a perspective view of ignitor and indicator circuit constructed in accordance with an embodiment of the present invention.
Figure 7:
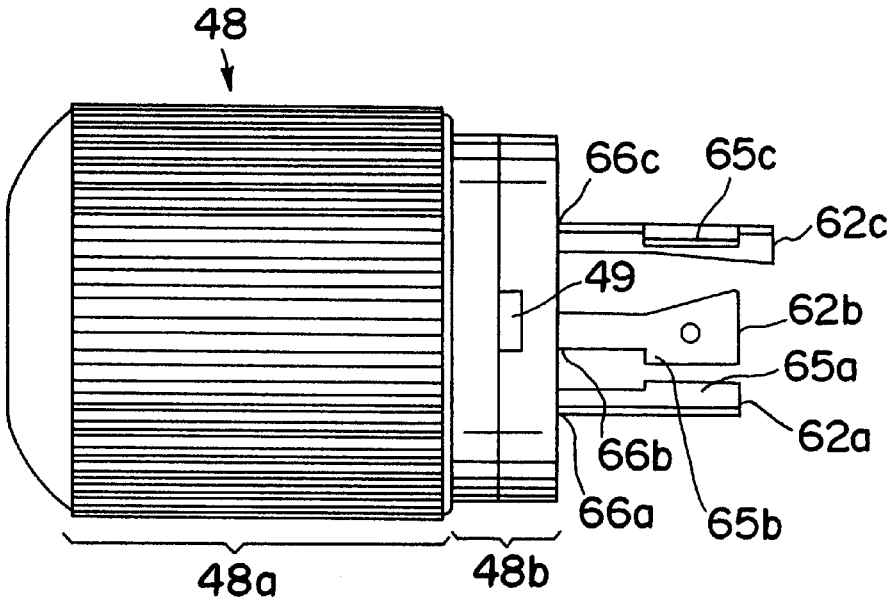
FIG. 7 is a side view of ignitor and indicator circuit constructed in accordance with an embodiment of the present invention.
Figure 8:
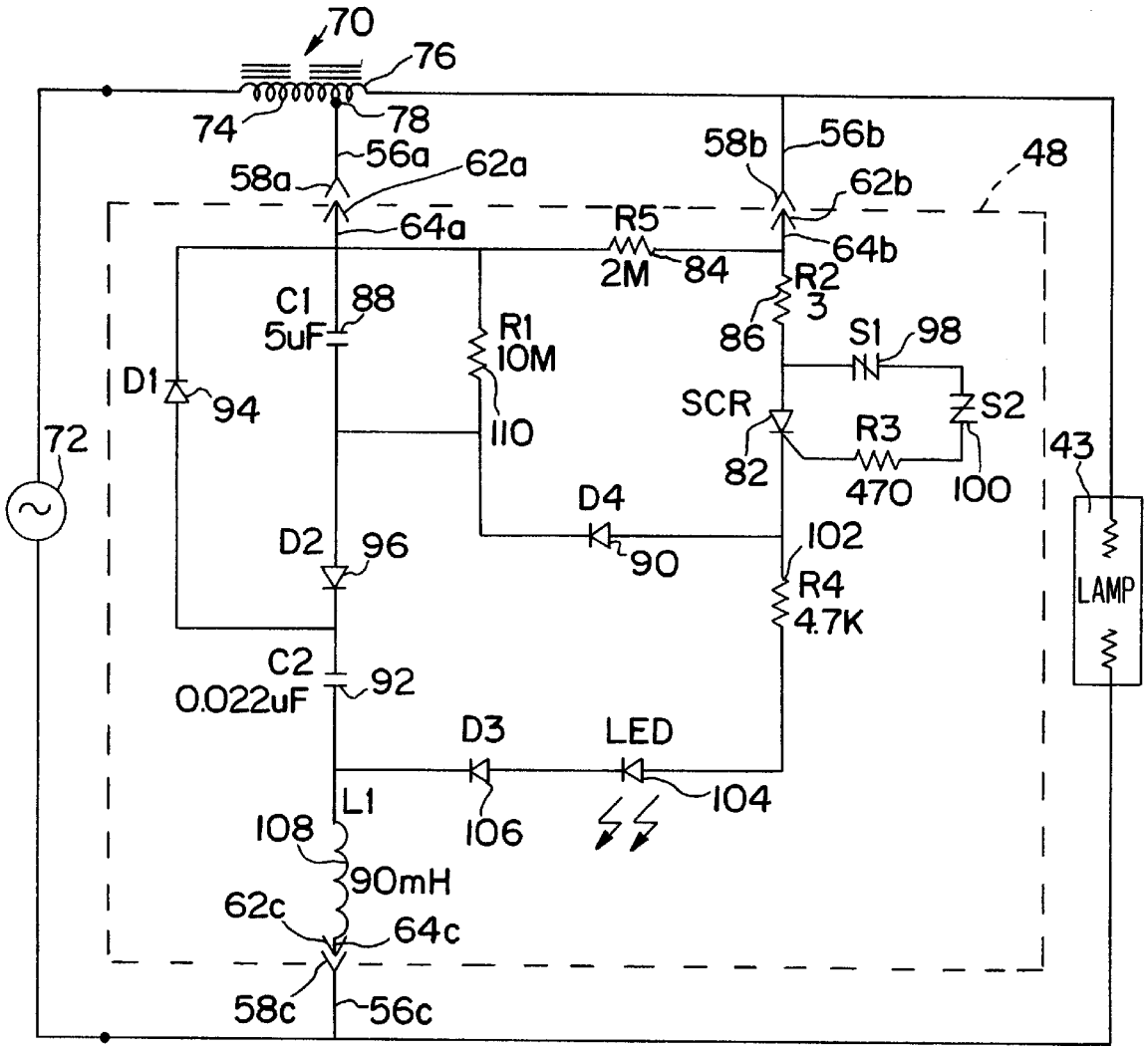
FIGS. 8, 9, 10, 11 and 12 are schematic diagrams illustrating ignitor and indicator circuits constructed in accordance with different embodiments of the present invention.
Figure 9:
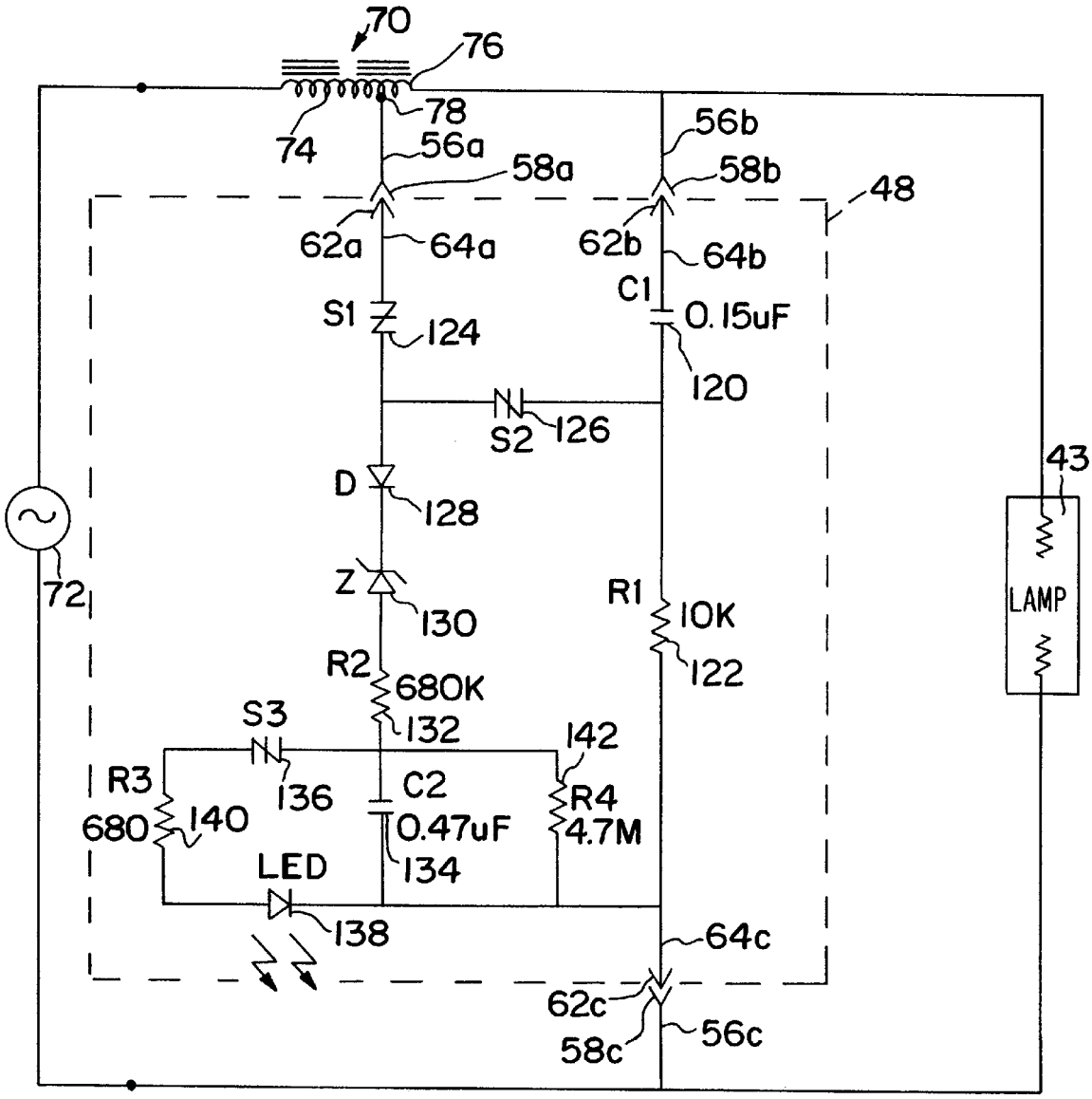
Figure 10:
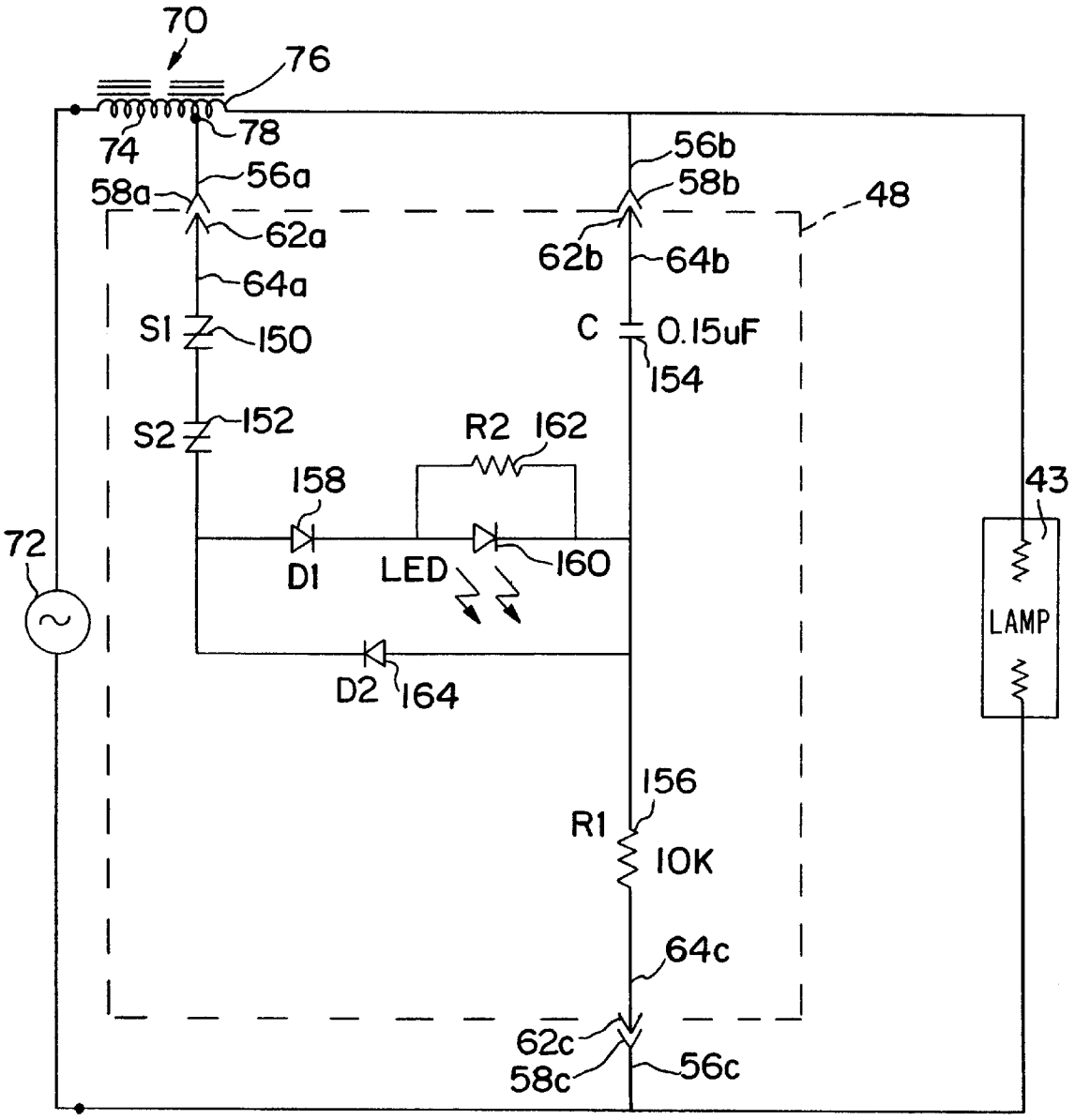

In accordance with an embodiment of the present invention, the receptacle 52 is provided with sockets (e.g., sockets 58*a*, 58*b* and 58*c*) for receiving respective contacts (e.g., 62*a*, 62*b* and 62*c*) provided on the ignitor and indicator circuit 48, as shown in FIGS. 5, 6 and 7. The sockets are electrically connected to respective wires indicated generally at 56 in the interior of the luminaire housing 44, which is indicated at 54 in FIGS. 3 and 4 for illustrative purposes. The luminaire housing 44 is preferably enclosed to protect the ballast, wiring and other components therein. The sockets, which are referred to collectively as sockets 58, can comprise conductive sheaths which extend through the thickness of the exterior portion 51, or through both of the exterior and interior portions 51 and 53, respectively, of the receptacle 52. The wires 56 preferably comprise a ballast tap wire 56*a*, a ballast secondary wire 56*b*, and a common or neutral wire 56*c*, as shown in FIGS. 8, 9 and 10. The wires 56*a*, 56*b* and 56*c* are electrically connected to respective ones of the sockets (e.g., sockets 58*a*, 58*b* and 58*c* ) in a conventional manner.

With reference to FIG. 4, the ignitor and indicator circuit (IIC) 48 is illustrated as being removed from the receptacle 52 in the partial view of the luminaire housing 44 to illustrate the contacts 62. In accordance with an embodiment of the invention illustrated in FIGS. 6 and 7, the IIC 48 comprises an enclosure having two cylindrical sections 48*a* and 48*b*. The section 48*a* encloses the ignitor components and the ignitor monitoring or indicator components, all of which are described below with regard to alternative embodiments in FIGS. 8, 9 and 10. The sections 48*a* and 48*b* can be formed from a nonconductive material such as plastic, for example. The outer circumference of the section 48*b* can be dimensioned to frictionally engage the inner circumference of the section 48*a* in a conventional manner for a snap fit. A notch 49 is provided in the section 48*b* to receive the end of a screw driver or knife or other tool to facilitate separating the sections 48*a* and 48*b* when desired. Section 48*b* is provided with three apertures through which the contacts 62*a*, 62*b* and 62*c* are inserted for mounting thereto. Wires 64*a*, 64*b* and 64*c* extending from the IIC components, as shown in FIGS. 8, 9 and 10, are electrically connected in a conventional manner to the contacts 62*a*, 62*b* and 62*c*. An opening or window 68 is provided in the housing section 48*a* through which light from an indicator such as a light-emitting diode or LED can be seen. The entire housing section 48*a* can also be clear or transparent which can be illuminated, if desired, by one or more light emitting devices located within the housing 48*a*.

With continued reference to FIGS. 6 and 7, the contacts 62*a*, 62*b* and 62*c* can be frictionally retained in the sockets 58*a*, 58*b* and 58*c*. In accordance with another embodiment of the present invention, the contacts 62*a*, 62*b* and 62*c* can be configured to have a locking-type connection with the sockets 58*a*, 58*b* and 58*c*, respectively. For example, one or more of the contacts 62*a*, 62*b* and 62*c* can be provided with a tab such as the tabs 65*a* and 65*c* shown in FIG. 6 and the tabs 65*a*, 65*b* and 65*c* shown in FIG. 7. As shown in FIGS. 6 and 7, the bases 66*a*, 66*b* and 66*c* of each of the contacts 62*a*, 62*b* and 62*c* have less width than the distal ends of the contacts due to the tabs 65*a*, 65*b* and 65*c*. The sockets 58*a*, 58*b* and 58*c* can be dimensioned to receive the distal end of respective ones of the contacts 62*a*, 62*b* and 62*c*, including their tabs 65*a*, 65*b* and 65*c*. Since the respective bases 66*a*, 66*b* and 66*c* are smaller, the IIC 48 can be rotated such that one side of each contact at the base 66*a*, 66*b* and 66*c* thereof (i.e., the side of the contact from which the tab 65*a*, 65*b* and 65*c* extends) abuts one side of the corresponding socket 58*a*, 58*b* and 58*c*. Accordingly, the tabs 65*a*, 65*b* and 65*c* prevent the IIC 48 from being separated from the receptacle 52 since the tabs are no longer aligned with the corresponding socket 58*a*, 58*b* and 58*c* by virtue of the rotation of the IIC 48 with respect to the luminaire housing 44.

Exemplary components for the IIC 48 are illustrated in FIG. 8. As stated previously, the luminaire 44 housing preferably encloses a ballast 70. The ballast 70 is electrically connected to a lamp 43 in a conventional manner. Power is provided to the ballast 70 from an alternating current (AC) power source 72 which can supply a line voltage such as 120 volts or 240 volts at 60 Hz, for example. The inductive ballast 70 has one end connected to the line voltage of the AC power source 72. The other end of the ballast 70 is connected to a first terminal of the lamp 43. The second terminal of the lamp is connected via a return path to the AC power source 72. Thus, the ballast 70 and the lamp 43 are in series across the AC power source 72.

The ballast 70 is preferably a tapped ballast having a first winding portion 74 and a second winding portion 76. A tap 78 is provided between the first and second winding portions 74 and 76. A semiconductor switch such as a siliconcontrolled rectifier (SCR) 82 or the like is connected such that one end of its switchable and conductive path is connected to the second winding portion 76 of the ballast 70 via resistors 84 and 86. The other end of the SCR 82 is connected to a terminal of a capacitor 88 via a diode 90. The other terminal of the capacitor 88 is connected to the ballast tap 78 via a IIC 48 wire 64*a*, the socket 58*a* and the corresponding wire 56*a* in the luminaire housing 44.

The circuit of the IIC 48 in FIG. 8 provides a high pressure sodium (HPS) lamp ignitor for cold lamp ignition, as well as hot lamp ignition following a power interruption, and also provides a visual indication of ignitor circuit operation. The operation of the ignitor is similar to that described in U.S. Pat. No. 5,321,338, which is hereby incorporated herein by reference for all purposes. The capacitor 88 is charged in a "stair step" manner by way of a voltage doubling circuit comprising capacitors 88 and 92 and diodes 94 and 96. During one half cycle of the AC power source 72, current flows through a choke 108, the capacitor 92 and the diode 94 to charge the capacitor 92. This capacitor is selected to be smaller than the capacitor 88. On the next half cycle, the capacitor 88 is charged and the voltage across the capacitor 92 facilitates the incoming half wave in delivering energy to the capacitor 88. On the next half cycle, the capacitor 92 is again charged and again delivers energy to the capacitor 88 on the subsequent half cycle, thereby increasing the voltage in the capacitor 88 in a kind of voltage multiplying or pumping action.

When the voltage across the capacitor 88 attains a voltage level substantially equivalent to the breakover voltage level of the sidacs 98 and 100 combined, the SCR 82 is turned on. Accordingly, the energy stored in the capacitor 88 is discharged through the portion of the ballast winding indicated at 76. By way of autotransformer action of the ballast 70, this energy is transformed into a high-voltage pulse which is sufficient to either cold-start or hot-start certain HPS lamps (e.g., the lamp 43). The main circuit path for the discharge of the energy stored in the capacitor 88 is through the ballast winding, the resistor 86, the SCR 82 and the diode 90. When the SCR 82 is on, the circuit branch comprising the resistor 86, a resistor 102, an indicator such as a light emitting diode (LED) 104, a diode 106 and a radio frequency choke 108 is placed across the output of the ballast 70. The combination of the open circuit voltage and the ignition pulses provides current through the circuit branch containing the LED 104 and therefore through the LED 104. Thus, the operation of the LED 104 is directly related to the operation of the SCR 82 and is therefore an indication that the ignitor circuit is functioning. Resistors 84 and 110 are useful to discharge the energy stored in the capacitors in the event that the IIC 48 is disconnected during operation. The rectifiers 90 and 106 prevent unwanted current from flowing in the circuit branch containing the LED 104. This particular ignitor generates a single ignition pulse every 2 to 5 seconds.

The ignitor circuit shown in FIG. 9 operates in a more conventional manner in that it generates over 100 pulses per second. A capacitor 120 is charged through a resistor 122 until the voltage reaches the breakover level of two sidacs 124 and 126 combined. When the sidacs 124 and 126 conduct, the energy stored in the capacitor 120 is transferred to a portion 76 of the ballast winding in the same manner as described in FIG. 8. When the sidac 124 begins to conduct, current flows in an additional circuit path consisting of a diode 128, a zener diode 130, a resistor 132 and a capacitor 134 which is connected between the ballast tap 78 and the common line 56*c*. The capacitor 134 is charged through the resistor 132 until its voltage reaches the breakover level of a sidac 136. As the sidac 136 conducts, energy stored in the capacitor 134 is transferred to an indicator such as LED 138 through a resistor 140. A resistor 142 is used in conjunction with the zener diode 130 to control the charge rate of the capacitor 134 and therefore the LED pulse frequency. The diode 128 is used to prevent reverse current flow when the ballast open-circuit voltage reverses polarity. The zener diode 130 can be omitted, depending upon ballast open-circuit voltage and desired LED pulse frequency.

FIG. 10 shows an ignitor circuit which is a less complex version of the circuit described in FIG. 9. The basic ignition operation is the same as previously discussed; however, when the sidacs 150 and 152 conduct the current resulting from the discharging of the capacitor 154, which has been charged through resistor 156, flows through a diode 158 and an indicator such as an LED 160 or a diode 164. The diode 158 is used to prevent reverse current from flowing through the LED 160 since the blocking voltage rating of the LED is low. The diode 164 is used as a current bypass around the LED branch in the reverse direction. As a result of this arrangement, the LED 160 only illuminates when the open-circuit voltage is positive with respect to the ballast common. Since there is no long time constant associated with this circuit, the LED 160 illuminates with the same frequency as the starter pulses on the positive half cycle which gives the appearance to the naked eye as being on constantly during ignitor operation.

Figure 11:
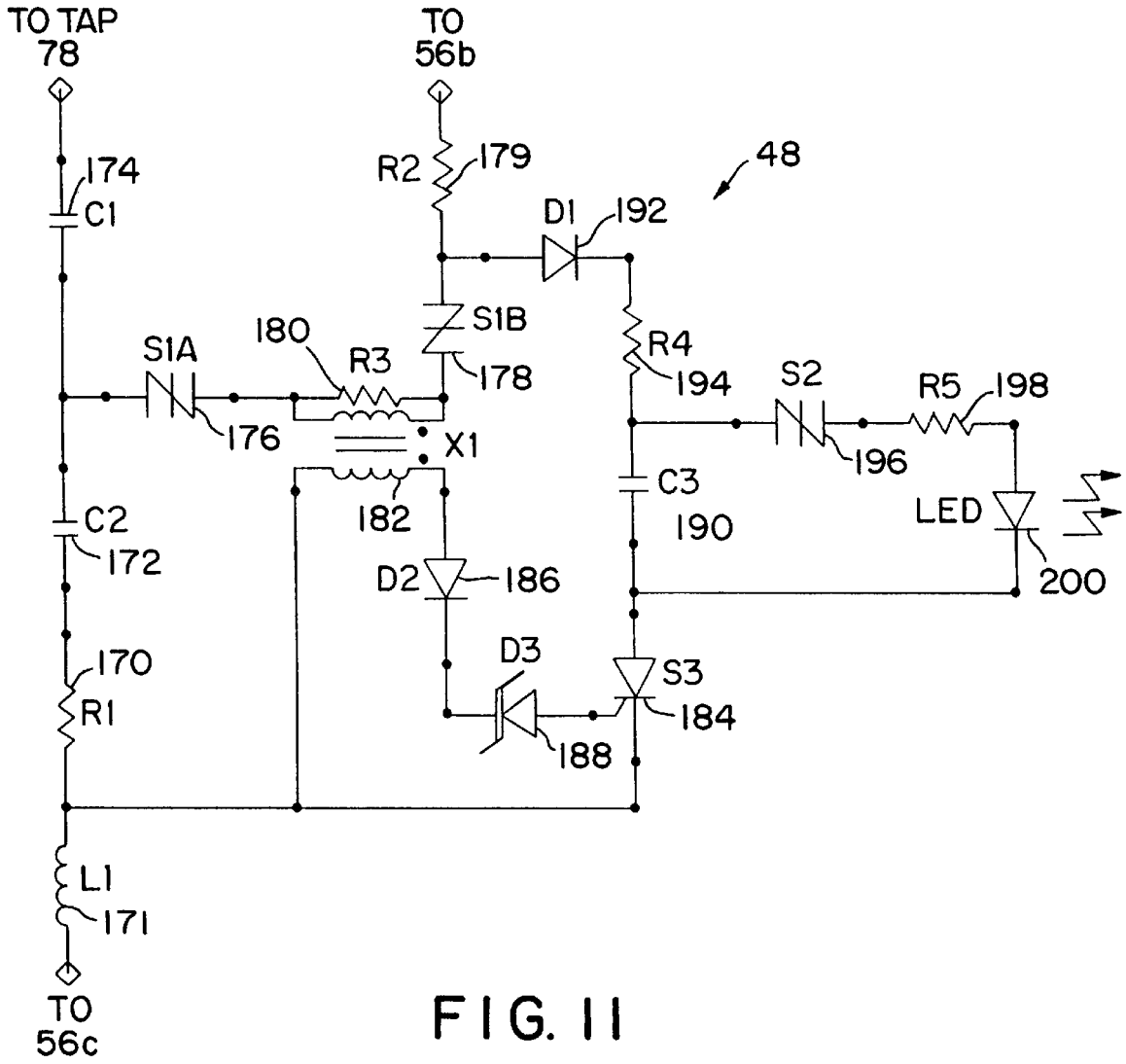

FIG. 11 depicts another ignitor circuit. The resistor 170 and the capacitor 172 provide an AC current charge path through the capacitor 174. The addition of the capacitor 172 reduces the voltage and power through the resistor 170; therefore, in effect, reducing the heat dissipation inside the twist-lock device enclosure. The capacitor 172 and the resistor 170 are chosen so that the AC voltage peak across the capacitor 174 is sufficient to exceed the series break-over voltage (Vbo) of semiconductor switches 176 and 178. A choke 171 is provided between the resistor 170 and the return path to the power source. A resistor 179 is connected in the ignitor current discharge path that includes the secondary winding of the ballast 70 (not shown). The capacitor 174 is preferably connected to the tap 78.

When the peak voltage across C1 has exceeded Vbo of the two semiconductor switches 176 and 178, they conduct current until the current decreases below a selected minimum value. The discharge current uses the transformation of the ballast 70 secondary winding and tap 78 to produce a high voltage ignitor pulse across the output of the ballast 70 (not shown). Also, during the same duration, the pulse current proceeds through a resistor 180 in parallel with a winding of a pulse transformer 182. Most of the current is shunted through the resistor 180; however, there is a voltage induced across the primary winding of the pulse transformer 182. The pulse transformer 182 then transforms the voltage into current for the trigger loop of the SCR 184. The pulse transformer 182 provides isolation of the LED charge/discharge loop from the ignitor discharge loop, thus providing no loading of the high voltage pulses. L1 also provides a means by which to prevent loading of the pulse. R2 is placed in the ignitor current discharge path to control the pulse height for different applications such as those promulgated by the American National Standards Institute (ANSI).

A trigger pulse occurring in one direction, as determined by the diode 186, turns the SCR 184 "on" during normal ignitor operation. The SCR 184 then provides the conduction path for current to charge the capacitor 190. The diode 192, the resistor 194, and the capacitor 190 provide a DC charge loop where DC energy is stored in the capacitor 190 at a rate determined by the resistor 194. The semiconductor switch 196 determines the level to which the capacitor 190 can charge. When the voltage across the capacitor 190 exceeds the Vbo of the semiconductor switch 196, current discharges through the LED 200 at a rate determined by the resistor 198. If the energy of the discharge is sufficient, the LED 200 emits light. In accordance with an advantage of the present embodiment, this will only occur if the SCR 184 is triggered to allow current to provide a DC charge across the capacitor 190.

The present embodiment is also advantageous because it provides fail mode operation. For example, if any leg in the circuit depicted in FIG. 11 opens in the ignitor portion thereof, the ignitor ceases to operate. If the ignitor does not operate, then the SCR 184 cannot be triggered. Eventually, this will lead to the LED 200 not turning on to indicate the status of proper operation in the ignitor (e.g., switches 176 and 178). If any leg shorts (i.e., the capacitor 174 or the resistor 170), the ignitor also ceases to operate in the normal manner which leads to the same conclusion, that is, improper operation of the ignitor.

If the capacitor 172 shorts, the current ignitor topology becomes a standard ignitor topology, which can cause an increase in power dissipation from the resistor and more heat in an enclosed environment. If either of the semiconductor switches 176 or 178 shorts, the ignitor continues to operate, but the pulse height will be diminished to the point that it will not ignite a HID lamp 43. The diode 188 is provided in the trigger loop to distinguish between proper operation and when either of the two primary semiconductor switches 176 and 178 fail or short. When proper ignitor pulse current occurs through the resistor 180, the voltage across the secondary of pulse transformer 182 is sufficient to overcome the reverse blocking power of the zener diode 188. When the height of the pulse transformer secondary voltage pulse is sufficient, the zener diode 188 allows current to conduct in order to continue with normal operation. If this voltage is not sufficient to overcome the reverse drop across the zener diode 188, the zener diode 188 does not allow the SCR 184 to be turned on. If the SCR 184 is not triggered, then the LED 200 will not "blink" and thereby indicate improper operation of the ignitor.

Figure 12:
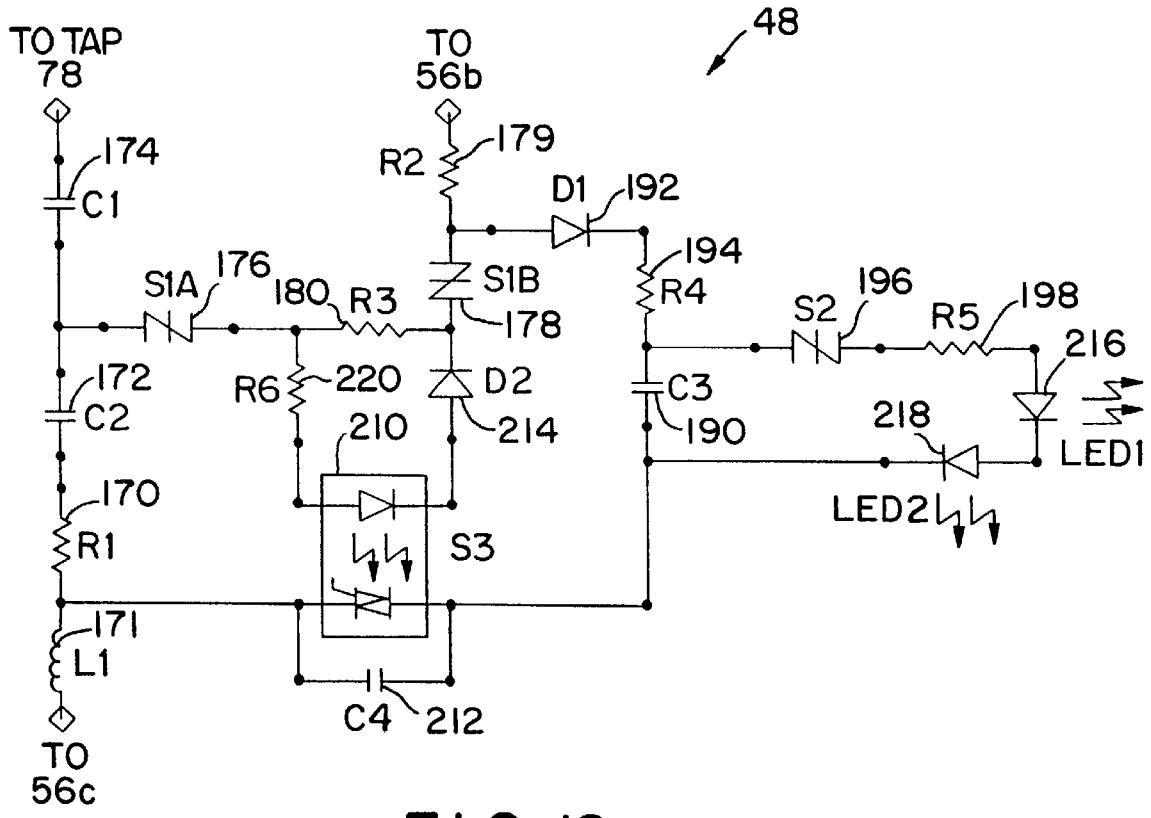

The ignitor circuit depicted in FIG. 12 has a number of components which are similar to those described above with reference to the ignitor circuit depicted in FIG. 11 and are therefore provided with the same reference numerals. For example, a resistor 170 and a capacitor 172 provide an AC current charge path through the capacitor 174. The addition of the capacitor 172 reduces the voltage and power through the resistor 170; therefore, in effect, reducing the heat dissipation inside the twist-lock device enclosure. The capacitor 172 and the resistor 170 are chosen so that the AC voltage peak across the capacitor 174 is sufficient to exceed the series break-over voltage (Vbo) of the semiconductor switches 176 and 178.

When the peak voltage across the capacitor 174 has exceeded Vbo of the two semiconductor switches, the switches 176 and 178 conduct current until the current decreases below selected minimum value. The discharge current uses the transformation of the ballast 70 secondary winding and tap 78 to produce a high voltage ignitor pulse across the output of the ballast 70 (not shown). Also, during the same duration, the pulse current proceeds through the resistor 180 in parallel with the input of optocoupler 210. Most of the current is shunted through the resistor 180; however, there is a energy induced across the optocoupler 210. The input of the optocoupler 210 then transforms the voltage into a luminous flux that, in turn, triggers the triac output of the optocoupler 210.

A capacitor 212 provides stabilization of the turn-on and turn-off of the triac output of the optocoupler 210. The capacitor 212 also provides a high-frequency bypass for current spikes to pass through, thereby protecting the triac output from harm (i.e., a snubber action). The optocoupler provides isolation of the charge/discharge loop for the LED1 216 and the LED2 218 from the ignitor discharge loop, thereby providing no loading of the high voltage pulses. The choke 171 also provides means by which to prevent loading of the pulse.

A resistor 220 is placed in the circuit of FIG. 12 to limit the current that passes through the input of the optocoupler 210 in order not to exceed its recommended specification. The diode 214 adds additional reverse voltage/current protection to insure that the current passing through the input of optocoupler only occurs in one direction. The resistor 179 is placed in the ignitor current discharge path to control the pulse height for different applications such as ANSI applications.

A trigger pulse occurring in one direction, and limited by the resistor 220 and the diode 214, turns the optocoupler 210 "on" during normal ignitor operation. The optocoupler 210 then provides the conduction path for current to charge the capacitor 190. The diode 192, the resistor 194, and the capacitor 190 provide a DC charge loop where DC energy is stored in the capacitor 190 at a rate determined by the resistor 194 and the capacitor 190. The semiconductor switch 196 determines the level to which the capacitor 190 can charge. When the voltage across the capacitor 190 exceeds the Vbo of the switch 196, current discharges through the LEDs 216 and 218 at a rate determined by the resistor 198. If the energy of the discharge is sufficient, the LED emits light. This will only occur if the optocoupler 210 is triggered to allow current to provide a DC charge across the capacitor 190 in accordance with an advantage of the present invention.

The present invention is also advantageous because it provides fail mode operation. For example, if any leg in the circuit opens in the ignitor portion of the circuit of FIG. 12, the ignitor ceases to operate. If the ignitor does not operate, then the optocoupler 210 will not be triggered. The LEDs therefore do not turn on to indicate the status of proper operation in the ignitor. If any leg shorts (i.e., the capacitor 174 or the resistor 170), the ignitor will cease to operate in a normal manner which leads to the same conclusion, that is, improper operation of the ignitor. If the capacitor 172 shorts, the current ignitor topology becomes a standard ignitor topology. The only potential, undesirable reaction in this fail mode is an increase in power dissipation from the resistor. This may produce excess heat in an enclosed environment. If either of the switches 176 or 178 shorts, the ignitor continues to operate, but the pulse height will be diminished to the point that it will not reliably ignite a HID lamp 43. The optocoupler 210, in conjunction with the resistor 220 and the diode 214, can distinguish between proper operation and when either of the two primary semiconductor switches 176 and 178 fail or short. This is due to the lowered "sensed" voltage across the resistor 180. The current that passes through the primary of the optocoupler 210 must be of sufficient quantity to trigger its output. With the voltage across the resistor 180 being lower, the current that passes through the primary of the optocoupler 210 is insufficient to trigger the device properly. Thus, proper pulse current through the resistor 180 is needed to produce the correct voltage across the primary of the optocoupler 210 that is sufficient to overcome the minimum trigger current specification of the optocoupler 210.

The HID luminaire of the present invention is advantageous because it is provided with an externally mounted ignitor and ignitor monitoring device, that is, an IIC 48. The ignitor monitoring device provides a visual indication of whether or not the ignitor of the lamp in the HID luminaire is functioning. The ignitor can be, for example, any of the circuits described above in connection with FIGS. 8–12 for cold-starting or hot starting the lamp 43. If the lamp 43 is not on and the LED of the IIC 48 is activated, this indicates that sufficient open circuit voltage is present to start and operate the lamp 43. A service person can assume that the lamp 43 is defective and can replace the lamp 43 as a first attempt to correct the problem with the luminaire 40. If the lamp 43 is off and the LED of the ignitor and the ignitor monitoring device (i.e., the IIC 48) is also not operating, this indicates that the lamp 43 is not operating for any of a number of reasons such as a defective ignitor, a defective ballast 70 or ballast capacitor (not shown), a defective lamp 43 or loss of supply voltage for the power source 72. A service person can replace the ignitor in a first attempt to repair the luminaire 40. Replacing the ignitor is the simplest initial repair option since the ignitor is enclosed with the ignitor monitoring device (e.g., IIC 48) in a housing (e.g., sections 48*a* and 48*b* ) that is externally mounted on the luminaire 40. If the ignitor is indeed the problem, the service person has repaired the luminaire 40 without having to disassemble the luminaire which comprises the lamp, the ballast, and other components in a luminaire housing 44. In addition, the risk of exposing the service person to electric shock via the supply wires to the luminaire to replace the ignitor. Further, supply voltage to the luminaire did not have to be interrupted by the service person to replace the externally mounted ignitor (e.g., the IIC 48).

The luminaire 40 of the present invention has been described as having three sockets for connecting to three contacts in an IEC 48. One of the contacts 62*c* and its corresponding socket 58*c* are configured to be larger than the other contact and socket pairs 62*a* and 58*a*, and 62*b* and 58*b*, respectively, to facilitate alignment of the IIC 48 to the receptacle 52 for connection of each contact 62*a*, 62*b* and 62*c* to the appropriate one of the sockets 58*a*, 58*b* and 58*c*. It is to be understood that the IIC 48 and the receptacle 52 and luminaire 40 can be constructed with fewer or additional contacts 62 and sockets 58 than the illustrated embodiment. In addition, the electrical connections of the IIC 48 to different points in the luminaire housing (44 e.g., via wires 56*a*, 56*b* and 56*c* ) can be changed depending on the ignitor. Also, the receptacle 52 can be provided with prongs connected to the wires 56*a*, 56*b* and 56*c* in lieu of the sockets 58*a*, 58*b* and 58*c*. Accordingly, the HC housing 48 can be configured with a female connector for receiving the prongs on the receptacle 52. The female connector is connected to the wires 64*a*, 64*b* and 64*c*, respectively.

While certain advantageous embodiments have been chosen to illustrate the invention, it will be understood by those skilled in the art that various changes and modifications can be made therein without departing from the scope of the invention as defined in the appended claims.

What is claimed:

1. An ignitor and ignitor monitoring device for a luminaire having a ballast and a discharger lamp, the ignitor and ignitor monitoring device comprising:

an ignitor circuit operable to generate pulses through at least a portion of said ballast to start said lamp;

an indicator and an indicator operating circuit therefor; and an isolation circuit between said ignitor circuit and said indicator operating circuit, said isolation circuit controlling the charging of a capacitor in said indicator operating circuit depending on the height of the pulses generated via the ignitor circuit, said isolation circuit preventing said capacitor from charging and operating said indicator when said pulses decrease below a selected threshold corresponding to failure of said ignitor circuit.

* * * * *